US007534760B2

(12) United States Patent
Johansson et al.

(10) Patent No.: US 7,534,760 B2
(45) **Date of Patent: *May 19, 2009**

(54) HIGHLY ALKALINE COMPOSITIONS CONTAINING A HEXYL GLYCOSIDE AS A HYDROTROPE

(75) Inventors: Ingegard Johansson, Gothenburg (SE); Bo Karlsson, Skarhamn (SE); Christine Strandberg, Molndal (SE); Gunvor Karlsson, Stenungsund (SE); Karin Hammarstrand, Kode (SE)

(73) Assignee: Akzo Nobel N.V., Arnhem (NL)

( * ) Notice: Subject to any disclaimer, the term of this patent is extended or adjusted under 35 U.S.C. 154(b) by 535 days.

This patent is subject to a terminal disclaimer.

(21) Appl. No.: 11/129,457

(22) Filed: May 13, 2005

(65) Prior Publication Data

US 2005/0215462 A1 Sep. 29, 2005

Related U.S. Application Data

(63) Continuation of application No. 10/342,904, filed on Jan. 15, 2003, now abandoned, which is a continuation-in-part of application No. 09/562,410, filed on May 1, 2000, now Pat. No. 6,541,442.

(51) Int. Cl.

| | |
|---|---|
| ***C11D 3/22*** | (2006.01) |
| ***C11D 1/66*** | (2006.01) |
| ***D06L 1/12*** | (2006.01) |
| ***B08B 3/04*** | (2006.01) |

(52) U.S. Cl. ..... 510/470; 510/238; 510/239; 510/240; 510/245; 510/276; 510/356; 510/421; 510/435; 510/436; 510/466; 134/25.2; 134/42; 8/137; 8/138; 8/139

(58) Field of Classification Search ..... 510/238, 510/239, 240, 245, 276, 356, 421, 435, 436, 510/466, 470; 134/25.2, 42; 8/137, 138, 8/139

See application file for complete search history.

(56) References Cited

U.S. PATENT DOCUMENTS

| | | | | |
|---|---|---|---|---|
| 4,240,921 | A * | 12/1980 | Kaniecki | 510/422 |
| 4,488,981 | A | 12/1984 | Urfer et al. | 252/174.17 |
| 4,627,931 | A | 12/1986 | Malik | 252/153 |
| H468 | H | 5/1988 | Malik et al. | 252/542 |
| 5,205,959 | A * | 4/1993 | Schmid et al. | 510/422 |
| 5,464,547 | A | 11/1995 | Stehlin et al. | 252/8.7 |
| 5,494,486 | A | 2/1996 | Stehlin et al. | 8/125 |
| 5,525,256 | A | 6/1996 | Morris et al. | 252/108 |
| 6,015,839 | A * | 1/2000 | Milius | 516/134 |
| 6,337,352 | B1 | 1/2002 | Milius | |
| 6,541,442 | B1 * | 4/2003 | Johansson et al. | 510/470 |

FOREIGN PATENT DOCUMENTS

| | | |
|---|---|---|
| EP | 0075995 B1 | 4/1983 |
| EP | 0136844 B1 | 4/1985 |
| EP | 0589978 B1 | 4/1994 |
| EP | 0638685 A1 | 2/1995 |
| WO | WO 96/33255 | 10/1996 |
| WO | WO 97/34971 | 9/1997 |

OTHER PUBLICATIONS

*International Search Report,* for PCT/SE98/01634, dated Jan. 7, 1999.

Derwent Abstract for EP 0589978 B1, Apr. 6, 1994.

* cited by examiner

*Primary Examiner*—Brian P Mruk
(74) *Attorney, Agent, or Firm*—Ralph J. Mancini

(57) ABSTRACT

The present invention relates to a clear and stable, highly alkaline composition with controlled foaming, containing a high amount of surface active nonionic alkylene oxide adduct and a hexyl glycoside as a hydrotrope. This composition has a very good wetting and cleaning ability and can be used for cleaning of hard surfaces, in a mercerization process and for a cleaning, desizing or scouring process of fibres and fabrics.

26 Claims, No Drawings

HIGHLY ALKALINE COMPOSITIONS CONTAINING A HEXYL GLYCOSIDE AS A HYDROTROPE

This is a continuation of U.S. application Ser. No. 10/342,904 filed on Jan. 15, 2003, now abandoned, which is a continuation-in-part of U.S. patent application Ser. No. 09/562,410, filed May 1, 2000, now U.S. Pat. No. 6,541,442, which is based on International Application Number PCT/SE98/01634 filed on Sep. 15, 1998, which claims priority of Sweden Patent Application No. 9703946-5, filed on Oct. 29, 1997.

FIELD OF THE INVENTION

The present invention relates to a clear and stable, highly alkaline composition with controlled foaming, containing a high amount of surface active nonionic alkylene oxide adduct and a hexyl glycoside as a hydrotrope. This composition has a very good wetting and cleaning ability and can be used for cleaning of hard surfaces, in a mercerization process and for a cleaning, desizing or scouring process of fibres and fabrics.

BACKGROUND OF THE INVENTION

Highly alkaline compositions, such as concentrates having a high content of alkaline agents, such as alkali hydroxides, alkaline complexing agents and silicates, and having a pH value above 11, preferably above 13, are frequently used for cleaning of hard surfaces, for mercerization, scouring etc. A good wetting ability combined with a good cleaning effect is essential in the above-mentioned applications, which requires the presence of considerable amounts of suitable surfactants to lower the high surface tension caused by the high amount of electrolytes. It is also important to have a controlled foaming in these systems. To minimize the cost of transportation, these concentrates should contain as small amounts of water and other solvents as possible. It is also advantageous if the concentrates remain homogenous during transportation and storage.

Since these compositions contain high amounts of electrolytes, such as alkali and/or alkaline complexing agents, it is difficult to dissolve larger amounts of surfactants, especially nonionic surfactants. Therefore, in order to improve the solubility, hydrotropes are often added, and the most commonly used hydrotropes are ethanol and sodium xylene or cumene sulphonate. Ethanol is rather efficient, but presents an explosion hazard, and sodium xylene or cumene sulphonate is relatively inefficient at higher surfactant levels. If a surfactant that is soluble in alkaline water solutions without the addition of a hydrotrope is used, there will be a problem with too much foam, which requires the addition of a foam depressor.

Alkyl glycosides have earlier been used in highly alkaline compositions, see for example EP-B1-589 978, EP-A1-638 685 and U.S. Pat. No. 4,240,921. Furthermore, alkyl glycosides are well known as active cleaning agents in commonly used cleaning compositions, see e.g. WO 97/34971, U.S. Pat. No. 4,627,931 and EP-B1-075 995.

EP-B1-589 978 describes the use of $C_8$-$C_{14}$ alkyl glycosides as surface active auxiliaries in the desizing, bleaching and alkaline scouring of natural and/or synthetic sheet-form textile materials, yarns or flocks, while EP-A1-638 685 relates to a mercerizing wetting agent containing, either alone or in combination, a $C_4$-$C_{18}$ alkyl glycoside, a $C_4$-$C_{18}$ alkyl glyconic amide and the corresponding sulphonated derivatives. Liquid highly alkaline cleaning concentrates containing an alkyl glycoside or an alkyl glycidyl ether and surface active nonionic alkylene oxide adducts are described in U.S. Pat. No. 4,240,921. The preferred alkylene oxide adducts are the ones capable of acting as foam depressors, such as polyoxyethylene/polyoxypropylene block copolymers and capped alcohol ethoxylates. The concentrate contains a) 10-35% by weight of alkali metal hydroxide,
b) 10-50% by weight of a mixture of a first nonionic surfactant which is a polyoxypropylene polyoxyethylene condensate that acts as a foam depressor and a second nonionic surfactant which is a capped ethoxylated alcohol together with an alkyl glycoside or an alkyl glycidyl ether, where the weight ratio between the alkyl glycoside or the alkyl glycidyl ether and the before-mentioned first and second nonionic surfactants is between 5:1 to 10:1 and
c) water to balance.

These concentrates are used to formulate low foaming cleaning compositions having utility e.g. in the food industry.

However, the above composition disclosed in U.S. Pat. No. 4,240,921 requires a rather high ratio of alkyl glycoside to the other nonionic surfactants present in the composition. Further, it is well known that the inclusion of larger amounts of PO in an alkoxylate, such as in foam depressors of the Pluronic type, has a negative influence on the biodegradability of the product. Finally, a capped alcohol ethoxylate normally is a poor wetting agent and has in addition a low cleaning ability. Its presence also increases the need for an extra amount of the alkyl glycoside or alkyl glycidyl ether.

There is consequently a need for highly alkaline compositions with improved properties.

SUMMARY OF THE INVENTION

The present invention generally relates to a method for improving the solubility of a surface active nonionic alkylene oxide adduct in a highly alkaline composition, said adduct containing a hydrocarbon group or an acyl group of from 8 to 24 carbon atoms and at least one primary hydroxyl group in the alkoxylated part of the molecule, said method comprising adding a hydrotrope to said highly alkaline composition, said hydrotrope comprising a hexyl glycoside having the formula $$C_6H_{13}OG_n \quad \text{(I)},$$

where G is a monosaccharide residue and n is from 1 to 5.

The invention also relates to a composition having a pH value above 11, which contains a) 3-50% by weight of alkali hydroxide and/or alkaline complexing agents,
b) 0.05-30% by weight of a surface active nonionic alkylene oxide adduct having a hydrocarbon group or an acyl group of from 8 to 24 carbon atoms and having at least one primary hydroxyl group in the alkoxylated part of the molecule,
c) 0.04-30% by weight of a hexyl glycoside, and
d) 20-97% by weight of water.

DETAILED DESCRIPTION OF THE INVENTION

It has now been found that highly alkaline compositions having a pH above 11, preferably at least 13 and most preferably above 13.7, that exhibit an excellent cleaning and wetting ability, can be prepared by using a hexyl glycoside having the formula $$C_6H_{13}OG_n \quad \text{(I)},$$

where G is a monosaccharide residue and n is from 1 to 5, as a hydrotrope for a surface active nonionic alkylene oxide adduct that is not soluble in the highly alkaline composition and contains a hydrocarbon group or an acyl group of from 8 to 24 carbon atoms and at least one primary hydroxyl group in the alkoxylated part of the molecule. Suitably the adduct has the formula $$R(AO)_x(C_2H_4O)_yH \quad (II),$$

where R is an alkoxy group R'O— having 8 to 24 carbon atoms or a group R"CONR'"—, where R" is a hydrocarbon group having 7 to 23 carbon atoms, R'" is hydrogen or the group —$(AO)_x(C_2H_4O)_yH$, preferably hydrogen, AO is an alkyleneoxy group with 2-4 carbon atoms, x is a number from 0 to 5 and y is a number from 1 to 10.

In a preferred embodiment, the composition of the invention contains less than 5%, preferably less than 4%, and still more preferably less than 3% by weight of an end-capped polyethylene glycol ether compound corresponding to formula I $$R_1O—(CH_2CH_2O)_n—R_2 \quad (I)$$

Wherein the radical R1O is derived from 2-branched, even numbered alkanols containing from 16-20 carbon atoms, R2 is an alkyl radical containing 4-8 carbon atoms, and n is a number of about 5 to about 9. Examples of such compounds include compounds where the radical R1O is derived from an alcohol mixture selected from the group consisting of (1) about 10 to about 100 mol percent of an equimolar isomer mixture of 2-hexyl-1-dodecanol and 2-octyl-1-decanol, 0 to about 90 mol percent of 2-hexyl-1-decanol, and 0 to about 90 mol percent of 2-octyl-1-dodecanol, and (b) about 40 to about 70 mol percent of 2-hexyl-1-decanol and about 60 to about 30 mol percent of 2-octyl-1-dodecanol.

The present invention also relates to a composition having a pH value above 11, which contains a) 3-50% by weight of alkali hydroxide and/or alkaline complexing agents,
b) 0.05-30% by weight of a surface active nonionic alkylene oxide adduct having a hydrocarbon group or an acyl group of from 8 to 24 carbon atoms and having at least one primary hydroxyl group in the alkoxylated part of the molecule,
c) 0.04-30% by weight of a hexyl glycoside,
d) 20-97% by weight of water, and
e) which excludes an end-capped polyethylene glycol ether compound corresponding to formula I $$R_1O—(CH_2CH_2O)_n—R_2 \quad (I)$$

Wherein the radical R1O is derived from 2-branched, even numbered alkanols containing from 16-20 carbon atoms, R2 is an alkyl radical containing 4-8 carbon atoms, and n is a number of about 5 to about 9.

The weight ratio between the hexyl glucoside and the nonionic surfactant according to formula II is from 1:10 to 10:1, preferably from 1:10 to 4:1.

It should be pointed out that alkyl glucosides have been used in less alkaline detergent compositions, where the conditions are different. Examples of such compositions are to be found in U.S. Pat. No. 4,488,981 and EP-B1-136 844.

U.S. Pat. No. 4,488,981 and EP-B1-136 844 describe the use of $C_2$-$C_6$ alkyl glycosides for reducing the viscosity of and preventing phase separation in an aqueous liquid detergent, for instance in liquid shampoos and soaps and in heavy duty liquids. The $C_2$-$C_4$ alkyl glycosides are the most preferred alkyl glycosides, since they are most effective in reducing the viscosity.

Furthermore, in U.S. Pat. No. 5,525,256 and in Statuary Invention H 468 industrial and institutional alkaline liquid cleaning compositions containing $C_8$-$C_{25}$ alkyl glycosides as cleaning agents are described.

However, none of these references discloses the unexpected effects of hexyl glycosides in highly alkaline cleaning compositions, containing at least 3%, preferably at least 20% alkali and/or alkaline builders and having a pH-value above 11, preferably at least 13, and most preferably above 13.7.

Suitable examples of nonionic surfactants according to formula II are alkylene oxide adducts obtained by alkoxylation of an alcohol or an amide. The R group in formula II may be branched or straight, saturated or unsaturated, aromatic or aliphatic. Examples of suitable hydrocarbon groups R' are 2-ethylhexyl, octyl, decyl, cocoalkyl, lauryl, oleyl, rape seed alkyl and tallow alkyl. Especially suitable hydrocarbon groups R' are those obtained from oxoalcohols, Guerbet alcohols, methyl substituted alcohols with 2-4 groups having the formula —$CH(CH_3)$— included in the alkyl chain, and straight alcohols. Other suitable R groups are the R"CONH— aliphatic amido groups, where R"CO is preferably derived from aliphatic acids such as 2-ethylhexanoic acid, octanoic acid, decanoic acid, lauric acid, coconut fatty acid, oleic acid, rape seed oil fatty acid and tallow fatty acid.

The alkali hydroxide in the composition is preferably sodium or potassium hydroxide. The alkaline complexing agent can be inorganic as well as organic. Typical examples of inorganic complexing agents used in the alkaline composition are alkali salts of silicates and phosphates, such as sodium tripolyphosphate, sodium orthophosphate, sodium pyrophosphate, sodium phosphate and the corresponding potassium salts. Typical examples of organic complexing agents are alkaline aminopolyphosphonates, organic phosphates, polycarboxylates, such as citrates; aminocarboxylates, such as sodium nitrilotriacetate ($Na_3NTA$), sodium ethylenediaminetetraacetate, sodium diethylenetriaminepentaacetate, sodium 1,3-propylenediaminetetraacetate and sodium hydroxyethylethylenediaminetriacetate.

The wetting of the composition is attributable to the nonionic surfactant present. The hexyl glycoside is not a wetting agent in itself, but by acting as a hydrotrope for the surfactant it enhances the wetting ability of the composition, since the otherwise insoluble surfactant now is dissolved and can exert its wetting ability. Concentrates with unexpectedly high amounts of surfactants can be dissolved in a highly alkaline aqueous phase, and the amount of hydrotrope needed to obtain a stable, clear concentrate or composition is less than in prior art. This is very surprising, since in formulations with other short-chain alkyl glycosides, it is not possible to include as large amounts of surface active nonionic alkylene oxide adducts as when n-hexyl glucoside is present in the formulations. For a comparison, formulations have also been made with both shorter and longer alkyl glucosides, which is illustrated in Example 1.

The composition of the present invention also exhibits a controlled foaming without the need to add foam depressors as those used in prior art. The products in the composition all have good environmental properties. They are readily biodegradable and of low toxicity.

The composition has an excellent wetting and cleaning ability and can advantageously be used for the alkaline cleaning of hard surfaces, e.g. vehicle cleaning, in a mercerisation process and for a cleaning, desizing or scouring process of fibres and fabrics performed at a pH above 11.

When used for the cleaning of hard surfaces, the composition is normally diluted with water prior to use, whereas in a mercerisation process, the composition can be used as such. For the cleaning, desizing and scouring of fibres and fabrics the composition could either be used as such or diluted.

When producing woven fabrics, the warp threads are subject to extreme stresses and must therefore be provided with a protective coating—the sizing agent—that adheres to the fibre, forming an abrasion-resistant, elastic film. The two main groups of sizing agents are macromolecular natural products and their derivatives, e.g. starches and carboxymethyl cellulose, and synthetic polymers, e.g. polyvinyl compounds. The sizing agent must be completely removed when the cloth has been woven, since it usually has a deleterious effect on subsequent finishing processes. The desizing process can be enzymatic or oxidative and is usually carried out to completion in the subsequent alkaline scouring and bleaching stages, where the initially water-insoluble starch degradation products and the residual sizes are broken down partly hydrolytically and partly oxidatively and removed.

During the scouring, intra- and intermolecular hydrogen bonds of cellulose are broken, and the polar hydroxyl groups of the polysaccharide are solvated. Transport of impurities from the inside to the outside of the fibre occurs. In the alkaline environment hydrolytic decomposition of different plant parts takes place and fats and waxes are also hydrolysed. The alkali concentration used is ca 4-6% when using NaOH.

In the scouring process there is a need for auxiliaries to effect thorough wetting, emulsification and dispersion of water insoluble impurities, complexation of heavy metal ions and prevention of fibre damage by atmospheric oxygen. Here alkali-stable wetting agents and detergents constitute an important group of additives. It is also very important that an adequate amount of wetting agent/detergent is dissoluble in the alkaline water solution, which often requires the addition of a hydrotrope. The same applies to an even greater extent for the mercerization process, which is performed principally in order to improve the dyeability of cotton. The process involves treatment of cotton under tension with a ca 20-26% caustic soda solution at 15-25° C. for 25-40 s. This treatment destroys the spiral form of cellulose, whereby the accessibility to water and, consequently, to water-based dyes, is improved. In addition to a good wetting ability and alkaline stability, it is also important that the additives do not cause foaming, since this would impede the rapid wetting required in the mercerization baths.

The present invention is further illustrated by the following Examples.

EXAMPLE 1

This example illustrates the amount of different alkyl glucoside hydrotropes, $RO(G)_n$, that is needed to obtain clear solutions of 5% nonionic surfactant in solutions containing 10, 20, 30 and 40% NaOH. The nonionic surfactant used was a $C_{9-11}$ alcohol with a linearity above 80% that had been ethoxylated with 4 moles of ethylene oxide per mole alcohol in the presence of a narrow range catalyst. The glucosides tested are laboratory samples, except for the butyl glucoside which is a commercial sample from SEPPIC. The degree of polymerisation lies between 1.4 and 1.6 with the somewhat higher glucose amounts for the longer alkyl chains.

Procedure:

5% nonionic surfactant was added to water solutions with different amounts of sodium hydroxide. The hydrotropes tested were added dropwise at room temperature to those aqueous mixtures of nonionic and sodium hydroxide in an amount that was just sufficient to obtain a clear solution.

| NaOH (%) | n-butyl glucoside (%) | isoamyl glucoside (%) | n-hexyl glucoside (%) | Exxal 7 glucoside[1] (%) | 2-ethyl-hexyl glucoside (%) |
|---|---|---|---|---|---|
| 40 | — | — | 7.5 | 9.4 | — |
| | | | | Very viscous | |
| 30 | — | — | 4.0 | 9.4 | 15.0 |
| | | | | | Not stable |
| 20 | — | — | 3.5 | 4.7 | 8.1 |
| 10 | 13.8 | 7.6 | 3.3 | 3.6 | 4.6 |

— no clear solution was obtained

[1]a glucoside based on a methyl substituted alcohol containing groups having the formula —$CH(CH_3)$— included in the alkyl chain From the results it is evident that the solubilizing effect of the hexyl glucoside is superior to the solubilizing effects of the alkyl glucosides used for comparison.

EXAMPLE 2

To compare the efficiency of the n-hexyl glucoside to other kinds of hydrotropes, the same procedure was followed as described in Example 1.

| Hydrotrope in formulation | Amount of hydrotrope in 10% NaOH (%) | Amount of hydrotrope in 20% NaOH (%) | Amount of hydrotrope in 30% NaOH (%) | Amount of hydrotrope in 40% NaOH (%) |
|---|---|---|---|---|
| n-Hexyl glucoside | 3.3 | 3.5 | 4.0 | 7.5 |
| Octylimino-Dipropionate | 1.7 | 4.5 | — | — |
| Cumene sulphonate | 4.8 | — | — | — |

— no clear solution was obtained

The tests show an unexpectedly good solubilizing ability of the n-hexyl glucoside, especially at high alkaline contents.

EXAMPLE 3

The surface tension was measured according to du Nouy (DIN 53914). The first three solutions contained 5% of the same nonionic as was used in Example 1 and 2, and the different amounts of hydrotropes were the same as in Example 2.

For the solutions that contained only n-hexyl glucoside the amounts were (5+x)%, where x represents the amounts used in Examples 1 and 2.

| Hydrotrope in formulaTion | surface tension in 10% NaOH (mN/m) | surface tension in 20% NaOH (mN/m) | surface tension in 30% NaOH (mN/m) | surface tension in 40% NaOH (mN/m) |
|---|---|---|---|---|
| n-Hexyl glucoside | 27.9 | 30.0 | 29.3 | 40.8 |
| Octylimino-dipropionate | 27.8 | 29.6 | — | — |
| Cumene sulphonate | 29.1 | — | — | — |
| n-Hexyl glucoside and no surfactant | 31.9 | 33.5 | 37.1 | 55.9 |
| No hydrotrope or surfactant added | 64.6 | 68.4 | 74.2 | 85.1 |

no clear solution was obtained, and the surface tension was not measured for these formulations.

EXAMPLE 4

The modified Drave's test was used to measure the wetting ability of highly alkaline compositions containing the n-hexyl glucoside and nonionic surfactants, as compared to decyl glucoside alone. In the modified Drave's test, the sinking time in s is measured for a specified cotton yarn in approximately 0.1% surfactant solution. In this example the concentrations for hexyl glucoside and nonionic surfactant specified in the table below were used.

| Component | % by weight of component | % NaOH | sinking time (s) |
|---|---|---|---|
| n-Hexyl glucoside | 0.04 | 25 | 141 |
| C9-C11 alcohol + 4 EO | 0.05 | | |
| n-Hexyl glucoside | 0.05 | 25 | >2000 |
| Decyl glucoside | 0.05 | 25 | 472 |
| n-Hexyl glucoside | 0.08 | 6 | 7 |
| 2-ethylhexanol + 4 EO | 0.10 | | |
| n-Hexyl glucoside | 0.10 | 6 | >2000 |
| Decyl glucoside | 0.10 | 6 | 23 |

Decyl glucoside is used for a comparison, since it represents an example of a nonionic surfactant that is soluble in alkaline water solution in the absence of any hydrotrope.

As can be seen from the table, n-hexyl.glucoside has no wetting ability on its own.

EXAMPLE 5

The contact angle was measured with surfactant solutions, at concentrations specified in the table below, against a hydrophobic polymeric material (Parafilm). The angle is measured with a goniometer 1 min. after application of the fluid. Decyl glucoside is used for a comparison.

| Component | % by weight of component | % NaOH | Contact angle (□) |
|---|---|---|---|
| n-Hexyl glucoside | 0.08 | 25 | 41 |
| C9-C11 alcohol + 4 EO | 0.10 | | |
| n-Hexyl glucoside | 0.08 | 25 | 42 |
| 2-ethylhexanol + 4 EO | 0.10 | | |
| Decyl glucoside | 0.10 | 25 | 96 |

EXAMPLE 6

The foam is measured as mm foam produced in a 500 ml measuring cylinder with 49 mm inner diameter from 200 ml surfactant solution when the cylinder is turned around 40 times in one minute. The test is made at room temperature and the foam height is registrated directly and after 1 and 5 minutes. Decyl glucoside is used for a comparison.

| Component | % by weight of component | NaOH (%) | Foam height (mm) after 0 min | Foam height (mm) after 1 min after 5 min |
|---|---|---|---|---|
| n-Hexyl glucoside | 0.08 | 25 | 4 | 2 |
| C9-C11 alcohol + 4 EO | 0.10 | | | 0 |
| n-Hexyl glucoside | 0.08 | 25 | 5 | 4 |
| 2-ethylhexanol + 4 EO | 0.10 | | | 0 |
| Decyl glucoside | 0.10 | 25 | 88 | 85 |
| | | | | 83 |

EXAMPLE 7

The following two formulations were prepared to evaluate the cleaning efficiency of a formulation using n-hexyl glucoside as a hydrotrope compared to a formulation using sodium cumene sulphonate as a hydrotrope.

| Component | Formulation I % by weight of component | Formulation II % by weight of component |
|---|---|---|
| $C_9$-$C_{11}$ alcohol + 4 EO | 5 | 5 |
| NaOH | 10 | 10 |
| n-Hexyl glucoside | 6[1)] | — |
| Sodium cumene sulphonate | — | 12[1)] |
| Water | balance | balance |

[1)]This amount was needed to obtain a clear solution.

The cleaning efficiency of the formulations in the table above was evaluated using the following cleaning test: White painted plates were smeared with an oil-soot mixture obtained from diesel engines. 25 ml of the test solutions are poured onto the top of the oil-smeared plates and left there for one minute. The plates are then rinsed off with a rich flow of water. All solutions and the water are kept at a temperature of about 15-20° C. Both test solutions were placed on the same plate. The reflectance of the plates was measured with a Minolta Chroma Meter CR-200 reflectometer before and after cleaning.

The test was performed both with the concentrates and with solutions diluted 1:3 with water. The washed-away soil was calculated by the computer program integrated in the meter, whereby for formulation I according to the invention about 85% washed-away soil and for the reference formulation II about 44% washed-away soil was obtained. For the 1:3 diluted solutions the corresponding amounts were 68 and 21% respectively.

It was also found that, when using n-hexyl glucoside as a hydrotrope, the hydrophobic dirt that is emulsified in the cleaning process can easily be separated from the waste-water after dilution with water. This is an important advantage since there is a growing environmental demand for low oil content in waste-water.

EXAMPLE 8

The table below shows some examples of how much n-hexyl glucoside that is needed to obtain a clear solution in water with different types and amounts of nonionic surfactants with different amounts of $Na_3NTA$ added.

| Nonionic surfactant | % by weight of surfactant | % by weight of $Na_3NTA$ | % by weight of n-hexyl glucoside |
|---|---|---|---|
| $C_9$-$C_{11}$ alcohol + 6 EO | 20 | 20 | 19.2 |
| $C_9$-$C_{11}$ alcohol + 6 EO | 10 | 30 | 13.8 |
| $C_{12}$-$C_{14}$ alcohol + 6 EO | 20 | 20 | 16.5 |
| $C_{12}$-$C_{14}$ alcohol + 6 EO | 10 | 30 | 14.1 |
| $C_9$-$C_{11}$ alcohol + 4 EO | 5 | 35 | 7.5 |
| $C_9$-$C_{11}$ alcohol + 4 EO | 10 | 35 | 12.8 |
| Oleic acid monoethanolamide + 4 EO | 10 | 30 | 10.6 |
| Coco acid monoethanolamide + 2 EO | 30 | 10 | 11.9 |

We claim:

1. A method for improving the solubility of a surface active nonionic alkylene oxide adduct in a highly alkaline composition having a pH above 11, said adduct containing a hydrocarbon group or an acyl group of from 8 to 24 carbon atoms and at least one primary hydroxyl group in the alkoxylated part of the molecule, said method comprising adding a hydrotrope to said highly alkaline composition, said hydrotrope comprising a hexyl glycoside having the formula $$C_5H_{13}OG_n \quad \text{(I)},$$

where G is a monosaccharide residue and n is from 1 to 5, wherein the weight ratio between said hexyl glycoside and said surface active nonionic alkylene oxide adduct is from 1:10 to 4:1, and wherein said composition comprises 3-50% of an alkaline complexing agent as an alkaline agent.

2. The method of claim 1, wherein the adduct has the formula $$R(AO)_x(C_2H_4O)_yH \quad \text{(II)},$$

where R is an alkoxy group R'O— having 8 to 24 carbon atoms or a group R"CONR'"— where R" is a hydrocarbon group having 7 to 23 carbon atoms, R'" is hydrogen or the group —$(AO)_x(C_2H_4O)_yH$, AO is an alkyleneoxy group with 2-4 carbon atoms, x is a number from 0 to 5 and y is a number from 1 to 10.

3. The method of claim 1 wherein the alkaline composition has a pH-value above 13.

4. The method of claim 1 wherein the glycoside is a n-hexyl glycoside.

5. An aqueous alkaline composition having a pH-value above 11 which comprises a) 3-50% by weight of a an alkaline complexing agent, b) 0.05-30% by weight of a surface active nonionic alkylene oxide adduct having a hydrocarbon group or an acyl group of from 8 to 24 carbon atoms and having at least one primary hydroxyl group in the alkoxylated part of the molecule, c) 0.04-30% by weight of a hexyl glycoside, d) 20-97% by weight of water.

6. The composition of claim 5 wherein the nonionic surfactant is an alkoxylate having the formula $$R(AO)_x(C_2H_4O)_yH \quad \text{(II)}$$

where R is an alkoxy group R'O— having 8 to 24 carbon atoms or a group R"—CONR'"— where R" is a hydrocarbon group having 7 to 23 carbon atoms, R'" is hydrogen or the group —$(AO)_x(C_2H_4O)_yH$, AO is an alkyleneoxy group with 2-4 carbon atoms, x is a number from 0 to 5 and y is a number from 1 to 10.

7. The composition of claim 5 having a pH-value above 13.

8. The composition of claim 5 wherein the hexyl glycoside is n-hexyl glycoside.

9. A method for cleaning hard surfaces which comprises applying to said hard surfaces a cleaning effective amount of the alkaline composition of claim 5.

10. A method for cleaning, desizing or scouring fibers and fabrics which comprises adding a cleaning, desizing or scouring effective amount of the alkaline composition of claim 5 to said fibers and fabrics.

11. The method of claim 1 wherein said alkylene oxide adduct is obtained by alkoxylation of an alcohol or an amide.

12. The method of claim 2 wherein R' is 2-ethylhexyl, octyl, decyl, cocoalkyl, lauryl. oleyl, rape seed alkyl, or tallow alkyl.

13. The method of claim 2 wherein R' is derived from an oxoalcohol, Guerbet alcohol, methyl substituted alcohols or straight alcohols.

14. The method of claim 1 wherein said alkaline complexing agent is inorganic, organic, or a mixture thereof.

15. The method of claim 14 wherein said alkaline complexing agent is an inorganic alkali salt of silicate, phosphate, or a mixture thereof.

16. The method of claim 15 wherein said alkaline complexing agent is sodium tripolyphosphate, sodium orthophosphate, sodium pyrophosphate, sodium phosphate, and the corresponding potassium salts.

17. The method of claim 14 wherein said alkaline complexing agent is an alkaline aminopolyphosphonate, organic phosphate, polycarboxylate, aminocarboxylates, or a mixture thereof.

18. The method of claim 17 wherein said polycarboxylate is a citrate, and said aminocarboxylate is a sodium nitrilotriacetate ($Na_3NTA$), sodium ethylenediaminetetraacetate, sodium diethylenetrlaminepenteacatate, sodium 1,3-propylenediaminetetraacetate, sodium hydroxyethylethylenediaminetriacetate, or mixtures thereof.

19. The composition of claim 5 wherein said alkylene oxide adduct is obtained by alkoxylation of an alcohol or an amide.

20. The composition of claim 2 wherein R' is 2-ethylhexyl, octyl, decyl, cocoalkyl, lauryl, oleyl, rape seed alkyl, or tallow alkyl.

21. The composition of claim 2 wherein R' is derived from an oxoalcohol, Guerbet alcohol, methyl substituted alcohols or straight alcohols.

22. The composition of claim 5 wherein said alkaline complexing agent is inorganic, organic, or a mixture thereof.

23. The composition of claim 22 wherein said alkaline complexing agent is an inorganic alkali salt of silicate, phosphate, or a mixture thereof.

24. The composition of claim 23 wherein said alkaline complexing agent is sodium tripolyphosphate, sodium orthophosphate, sodium pyrophosphate, sodium phosphate, and the corresponding potassium salts.

25. The method of claim 22 wherein said alkaline complexing agent is an alkaline aminopolyphosphonate, organic phosphate, polycarboxylate, aminocarboxylates, or a mixture thereof.

26. The method of claim 25 wherein said polycarboxylate is a citrate, and said aminocarboxylate is a sodium nitrilotriacetate ($Na_3NTA$) sodium ethylenediaminetetraacetate, sodium diethylenetriaminepentaacetate, sodium 1,3-propylenediaminetetraacetate, sodium hydroxyethylethylenediaminetriacetate, or mixtures thereof.

* * * * *

UNITED STATES PATENT AND TRADEMARK OFFICE

CERTIFICATE OF CORRECTION

PATENT NO. : 7,534,760 B2
APPLICATION NO. : 11/129457
DATED : May 19, 2009
INVENTOR(S) : Ingegard Johansson et al.

It is certified that error appears in the above-identified patent and that said Letters Patent is hereby corrected as shown below:

In the claims:

Col. 10, line 33, claim 5, delete "a" before an alkaline complexing agent,

Col. 10, line 66, claim 12, change "lauryl."
to --lauryl,--

Col. 11, line 20, claim 18, change "diethylenetrlaminepenteacatate,"
to --diethethylenetriaminepentaacetate,--

Signed and Sealed this
Nineteenth Day of April, 2011

David J. Kappos

David J. Kappos
*Director of the United States Patent and Trademark Office*